US006186172B1

(12) United States Patent
Yoshida

(10) Patent No.: US 6,186,172 B1
(45) Date of Patent: Feb. 13, 2001

(54) DIRECTIONAL CONTROL VALVE APPARATUS

(75) Inventor: Nobumi Yoshida, Tochigi (JP)

(73) Assignee: Komatsu Ltd., Tokyo (JP)

( * ) Notice: Under 35 U.S.C. 154(b), the term of this patent shall be extended for 0 days.

(21) Appl. No.: 09/355,890

(22) PCT Filed: Feb. 12, 1998

(86) PCT No.: PCT/JP98/00572

§ 371 Date: Aug. 6, 1999

§ 102(e) Date: Aug. 6, 1999

(87) PCT Pub. No.: WO98/36176

PCT Pub. Date: Aug. 20, 1998

(30) Foreign Application Priority Data

Feb. 12, 1997 (JP) ..... 9-027601

(51) Int. Cl.[7] ..... F15B 13/043

(52) U.S. Cl. ..... 137/596.15; 91/446; 91/452; 91/455; 137/596.16; 137/596.2

(58) Field of Search ..... 91/436, 446, 452, 91/455; 137/596.15, 596.16, 596.2

(56) References Cited

U.S. PATENT DOCUMENTS 4,480,527 * 11/1984 Lonnemo ..... 91/436
4,693,272 * 9/1987 Wilke ..... 137/596
5,372,060 * 12/1994 Maruyama et al. ..... 137/596.15 X

FOREIGN PATENT DOCUMENTS 64-7902 1/1989 (JP) .
1-242802 9/1989 (JP) .
2-8502 1/1990 (JP) .
2-248705 4/1990 (JP) .
6-193605 7/1994 (JP) .

* cited by examiner

*Primary Examiner*—Gerald A. Michalsky
(74) *Attorney, Agent, or Firm*—Ronald P. Kananen; Rader, Fishman & Grauer

(57) ABSTRACT

A directional control valve system is provided in conjunction with a hydraulic actuator, using a meter-in flow control valve that is simple in structure to permit pressure fluid to be fed into a first and a second chamber of the hydraulic actuator. The directional control valve system includes a meter-in flow control valve 1 for establishing and blocking fluid communication of a pump port with an outlet port 12, a first and a second load checking valve 2 and 3 that is in fluid communication with the outlet port 12, and a meter-out flow control valve 4 for establishing fluid communication of one of a first and a second actuator port 72 and 74 at an output side of the first and second load checking valves 2 and 3 with a tank port 71, and has an arrangement that permits the first and second load checking valves 2 and 3 to be held in a closed state with pressure fluid. The system provides feeding a first and a second chamber 99*a* and 99*b* with pressure fluid from the first or second actuator port 72 or 74 notwithstanding a simple configuration of the meter-in flow control valve 1 to establish and block fluid communication between the outlet port 12 and the pump port.

12 Claims, 13 Drawing Sheets

DIRECTIONAL CONTROL VALVE APPARATUS

TECHNICAL FIELD

The present invention relates to a directional control valve system for feeding a hydraulic actuator with pressure fluid from a pressure fluid source.

BACKGROUND ART

A directional control valve system has been known having a meter-in flow control valve, a pair of load checking valves and a meter-out flow control valve in which one of the two load checking valves is fed with pressure fluid through the meter-in flow control valve to feed pressure fluid into a first chamber of a hydraulic actuator and pressure fluid in a second chamber of the hydraulic actuator is permitted to flow out into a reservoir through the meter-out flow control valve.

In such a directional control valve system, pressure fluid is fed selectively into one of the two load checking valves by switching the meter-in flow control valve. This requires the meter-in flow control valve to be provided with a pump port, a first outlet port and a second outlet port and to be constructed so that displacement of a spool may allow the first or second outlet port to communicate with the pump port. The essential need for these three ports has thus rendered the system unduly complex in structure.

It is accordingly an object of the present invention to provide a directional control valve system that can resolve the above-mentioned problem.

BRIEF SUMMARY OF THE INVENTION

A first form of the invention provided herein is a directional control valve system, characterized in that it comprises: a meter-in flow control valve 1 for establishing and blocking fluid communication of a pump port with a single outlet port 12; a first load checking valve 2 disposed between the said outlet port 12 and a first actuator port 72 and adapted to be held in a closed state in response to an external signal; a second load checking valve 3 disposed between the said outlet port 12 and a second actuator port 74 and adapted to be held in a closed state in response to an external signal; and a meter-out flow control valve 4 for establishing fluid communication of one of the said first actuator port 72 and the said second actuator port 74 with a tank port 71.

According to the first form of the invention, it can be seen and should be appreciated that bringing the pump port of the meter-in flow control valve 1 into fluid communication with the outlet port 12, holding the first load checking valve 2 in a closed state and bringing the first actuator port 72 of the meter-out flow control valve 4 into fluid communication with a first tank port 71 permits pressure fluid having flowed into the pump port to force the second load checking valve 3 to open and thereby to feed into the second actuator, and pressure fluid in the first actuator port 72 to flow out into the tank port 71.

Also, bringing the pump port of the meter-in flow control valve 1, into fluid communication with the outlet port 12 holding the second load checking valve 3 in a closed state and bringing the second actuator port 74 of the meter-out flow control valve 4 into fluid communication with tank port 71 allows pressure fluid that has flown into the pump port to force the first load checking valve 2 to open and thereby to feed into the first actuator port 72 and pressure fluid in the second actuator port 74 to flow out into the tank port 71.

It thus becomes possible for pressure fluid admitted into the pump port to be furnished into the first or second actuator port 72, 74 and for pressure fluid in the second or first actuator port 74, 72 to be caused to flow out into a reservoir, permitting a first chamber 99*a*, a second chamber 99*b* of a hydraulic actuator 99 to be supplied with pressure fluid.

It should also be noted that the meter-in flow control valve 1 requiring no more than two ports, i.e., only the pump port and the outlet port 12, becomes simple in structure.

A second form of the invention provided herein is a directional control valve system in which the meter-in flow control valve 1 in the first form of the invention described is constructed to include an outlet port 12, a first pump port 13, a second pump port 16 and a meter-in spool 19, and to be operable to block fluid communication between the ports when the meter-in spool 19 is located at a neutral position thereof and to be operable to establish fluid communication between the ports when the meter-in spool 19 is located at a first position that is on one side of the neutral position as well as when the meter-in spool 19 is located at a second position that is on the other side of the neutral position.

According to the second form of the invention, it can be seen and should be appreciated that moving the meter-in spool 19 in either one side or the other side establishes fluid communication of both the first and second pump ports 13 and 16 with the outlet port 12, thereby permitting pressure fluid admitted therein to flow out into the outlet port 12.

It thus becomes possible to feed a volumetric flow that is twice as large as the spool diameter, hence to make the spool 19 smaller in diameter and compact.

It should also be noted that pressure fluid that is discharged from a first hydraulic pump and pressure fluid that is discharged from a second hydraulic pump can be combined to flow into the outlet port 12 for supply into a hydraulic actuator.

A third form of the invention provided herein is a directional control valve in which coaxially with the first load checking valve 2 adopted in the first or second form of the invention there is disposed a relief valve for a check valve 63 for permitting fluid flow from the first actuator port 72 into a relief port 59, and coaxially with the second load checking valve 3 is so adopted that there is disposed a relief valve for a check valve 63 for permitting fluid flow from the second actuator port 74 into a relief port 59, these relief ports 59 being connected to a single relief valve 130 According to the third form of the invention, it can be seen and should be appreciated that pressure fluid in the first actuator port 72 is allowed to flow through the relief valve for the check valve 63 disposed coaxially with the first load checking valve 2, from a relief port 59 into the relief valve 130. Pressure fluid in the second actuator port 74 is allowed to flow through the relief valve for the check valve 63 disposed coaxially with the second load checking valve 3, from a relief port 59 into the relief valve 130.

Thus, providing a single relief valve is sufficient to prevent an abnormal rise in pressure in each of the first and second actuator ports 72 and 74. It should also be noted that if a plurality of first and/or second load checking valves 2, 3 are provided, connecting these relief ports 59 together with a path or paths can prevent every one of them from suffering from an abnormal pressure rise in it.

A fourth form of the invention provided herein is a directional control valve system in which the meter-out flow control valve 4 of the first, second or the third form of the invention described is adapted to block fluid communication between the ports when the meter-out spool 76 lies at the neutral position and to establish fluid communication of the first actuator port 72 with the tank port 71 when the meter-out spool 76 lies at the first position and to establish fluid communication of the second actuator port 74 with the tank port 71 when the meter-out spool 76 lies at the second position.

According to the fourth form of the invention, it can be seen and should be appreciated that moving the meter-out spool 76 to take one of its first and second positions establishes fluid communication of one of the first and second actuator ports 72 and 74 with the tank port 71.

This permits a switching operation to be performed of the meter-out flow control valve 4 with simplicity using an electromagnetic proportional pressure control valve or a hydraulic pilot valve.

A fifth form of the invention provided herein is a directional control valve system in which the meter-out flow control valve 4 adopted in the first, second or third form of the invention comprises a first meter-out flow control valve 4-1 and a second meter-out flow control valve 4-2, the said first meter-out flow control valve 4-1 is a poppet valve type to cause a poppet valve 100 provided for blocking fluid communication between the first actuator port 72 and the tank port 71 under a pressure in the first actuator port 72 to move towards a fluid communication position in response to an external signal, the poppet valve is movable to a fluid communication position when pressure in the tank port 71 is higher than pressure in the first actuator port 72, and the said second meter-out flow control valve 4-2 is a poppet valve type to cause a poppet valve 100 provided for blocking fluid communication between the second actuator port 74 and the tank port 71 under a pressure in the second actuator port 74 to move towards a fluid communication position in response to an external signal, the poppet valve is movable to a fluid communication position when pressure in the tank port 71 is higher than pressure in the second actuator port 74.

According to the fifth form of the invention, it can be seen and should be appreciated that the use of the poppet valve 100 for the first meter-out flow control valve 4-1 prevents pressure fluid from flowing out of the first actuator port 72 into the tank port 71. And the use of the poppet valve 100 for the second meter-out flow control valve 4-2 prevents pressure fluid from flowing out of the second actuator port 74 into the tank port 71.

It thus becomes possible to prevent a hold-pressure caused by the meter-out flow control valve 4 in the first or second actuator port 72 or 74 from leaking into a reservoir.

It should also be noted that the poppet valve 100 for the first meter-out flow control valve 4-1 is opened when the pressure in the tank port 71 is greater than the A pressure in the first actuator port 72. And the poppet valve 100 for the second meter-out flow control valve 4-2 is opened when the pressure in the tank port 71 is greater than the pressure second actuator port 74.

It is thus seen that the first and second meter-out flow control valves 4-1 and 4-2 are provided each with an intake or entrainment function which when each of the first and second actuator ports 72, 74 develops a negative pressure, draws or entrains pressure fluid from the tank port 71, thereby eliminating the negative pressure.

A sixth form of the present invention is a directional control valve system according to the second form of the invention in which each of the said first and second load checking valves 2 and 3 is adapted to be held in a closed state in the presence of pressure fluid acting on a pressure receiving area thereof and is adapted to operate in an open state with pressure fluid in the outlet port 12 in the absence of pressure fluid so acting on the pressure receiving area, and pressure fluid acting to move said meter-in spool 19 to its first position is utilized to cause pressure fluid to be fed to act on the pressure receiving area of the first load checking valve 2 and pressure fluid acting to move said meter-in spool 19 to its second position is utilized to cause pressure fluid to be fed to act on the pressure receiving area of the second load checking valve 3.

According to the sixth form of the invention, it can be seen and should be appreciated that moving the meter-in spool 19 to its first position feeds pressure fluid to act on the pressure receiving area of the first load checking valve 2 to hold it to be closed. And moving the meter-in spool 19 to its second position feeds pressure fluid to act on the pressure receiving area of the second load checking valve 3 to hold it to be closed.

Therefore, effecting a switching operation for the meter-in spool 19 alone can cause one or the other of the first and second load checking valves 2 and 3 to be closed, thus to make them readily operable.

A seventh form of the present invention is a directional control valve system in which each of the first and second load checking valves 2 and 3 of the second form of the invention is adapted to be held in a closed state in the presence of pressure fluid acting on a pressure receiving area thereof and is adapted to operate in an open state with pressure fluid in the outlet port 12 in the absence of pressure fluid so acting on the pressure receiving area, there being formed: a fluid feed passage for establishing fluid communication of the first pump port 13 with the pressure receiving area of the first load checking valve 2 and fluid communication of the second pump port 16 with the pressure receiving area of the second load checking valve 3 when said meter-in spool 19 lies at its neutral position, a fluid feed passage for establishing fluid communication of a first pump port 13 with the pressure receiving area of the first load checking valve 2 and fluid communication of the pressure receiving area of the second load checking valve 3 with the tank port when the meter-in spool 19 lies at its first position, and a fluid feed passage for establishing fluid communication of the second pump port 16 with the pressure receiving area of the second load checking valve 3 and fluid communication of the pressure receiving area of the first load checking valve 2 with the tank port when the meter-in spool 19 lies at its second position.

According to the seventh form of the invention, it can be seen and should be appreciated that the meter-in spool 19 assuming its neutral position holds the first and second load checking valves 2 and 3 each to be closed. Turning the meter-in spool 19 to its first position holds the first load checking valve 2 to be closed. And as turning the meter-in spool 19 to its second position holds the second load checking valve 3 to be closed.

This being the case, effecting a switching operation for the meter-in spool 19 alone can cause one or the other of the first and second load checking valves 2 and 3 to be held in a closed state, thus to make them readily operable.

An eighth form of the present invention is a directional control valve system according to the second form described in which each of the said first and second load checking valves 2 and 3 is adapted to be held in a closed state in the presence of pressure fluid acting on a pressure receiving area thereof and is adapted to be held in a closed state with a spring force and to operate in an open state with pressure fluid in the outlet port 12 in the absence of pressure fluid so acting on the pressure receiving area, there being formed: a fluid feed passage for establishing fluid communication of the pressure receiving areas of the first and second load checking valves 2 and 3 when the meter-in spool 19 lies at its neutral position with a tank port, a fluid feed passage for establishing fluid communication of a first pump port 13 with the pressure receiving area of the first load checking valve 2 and fluid communication of the pressure receiving area of the second load checking valve 3 with the tank port when the meter-in spool 19 lies at its first position, and a fluid feed passage for establishing fluid communication of a second pump port 16 with the pressure receiving area of the second load checking valve 3 and fluid communication of the pressure receiving area of the first load checking valve 2 with the tank port when the meter-in spool 19 lies at its second position.

A ninth form of the present invention is a directional control valve system according to the seventh form of the invention described in which when or before the first and second pump ports 13 and 16 communicate with the outlet port 12, the pressure receiving areas of the second and first load checking valves 3 and 2 are allowed to communicate with the tank port.

A tenth form of the present invention is a directional control valve system in which one of the first and second load checking valves 2 and 3 and the meter-out flow control valve 4 of the first form of the invention described are adapted to be operable in a closed state and switchably in response to a switching timing signal for the meter-in flow control valve.

According to the tenth form of the invention, it can be seen and should be appreciated that at the timing of switching the meter-in flow control valve 1, one of the first and second load checking valves 2 and 3 are turned into a closed state and also a switching operation of the meter-out flow control valve 4 is performed.

This provides feeding pressure fluid into one of the first and second actuator ports 72 and 74 at a predetermined timed instant.

An eleventh form of the present invention is a directional control valve system according to the second, fourth or fifth form of the invention described which includes a first meter-in electromagnetic proportional control valve 23 for moving the meter-in spool 19 for the said meter-in flow control valve 1 to its first position, a second meter-in electromagnetic valve 29 for moving the said meter-in spool 19 to its second position, a meter-out electromagnetic proportional pressure control valve 81, and a pilot switching valve 87 for switching an output pressure of the said electromagnetic proportional pressure control valve 81 over to a first and a second switchover pressure for switching the meter-out flow control valve 4, in which the said pilot switching valve 87 is adapted to be operatively switched with a pressure fluid for holding the first load checking valve 2 in a closed state or with an output pressure fluid of the first meter-in electromagnetic proportional pressure control valve 23.

According to the eleventh form of the invention, it can be seen and should be appreciated that since the pilot switching valve 87 is operatively switched with a pressure fluid that holds the first load checking valve 2 in a closed state or alternatively with an output pressure fluid that the first electromagnetic proportional pressure control valve 23, the output fluid pressure of the meter-out electromagnetic proportional control valve 81 is switched over to a first or second switching pressure level that is set to switch the meter-out flow control valve 4 by moving the meter-in spool 19 to its first or second position.

It can thus become possible to switch the meter-out flow control valve 4 with the aid of a single meter-out electromagnetic proportional pressure control valve 81.

A twelfth form of the present invention resides in a directional control valve system according to the second form of the invention described which further comprises a first meter-in electromagnetic proportional control valve 23 for causing the meter-in spool 19 for the meter-in flow control valve 1 to take its first position, a second meter-in electromagnetic proportional control valve 29 for causing the meter-in spool 19 to take its second position, a meter-out electromagnetic proportional pressure control valve 81, a first pilot switching valve 87-1 for controllably applying an output pressure of the said electromagnetic proportional pressure control valve 81 into a first pressure receiving chamber 79 to establish a first state of the meter-out flow control valve 4 in which a first actuator port 72 communicates with a drain port 71, and a second pilot switching valve 87-2 for controllably applying an output pressure of said electromagnetic proportional pressure control valve 81 into a second pressure receiving chamber 80 to establish a second state of the meter-out flow control valve 4 in which a second actuator port 74 communicates with a drain port 71 so that pressure fluid causing the meter-in spool 19 for said meter-in flow control valve 1 to take its first position causes the first pilot switching valve 87-1 to take a position of fluid communication, and pressure fluid causing said meter-in spool 19 to take its second position causes the second pilot switching valve 87-2 to take a position of fluid communication.

According to the twelfth form of the invention, it can be seen and should be appreciated that causing the first pilot switching valve 87-1 to take a fluid communication position with a pressure fluid that causes the meter-in spool 19 to take its first position and causing the second pilot switching valve 87-2 to take a fluid communication position with a pressure fluid that causes the meter-in spool 19 to take its second position permits an output pressure fluid of the meter-out electromagnetic proportional pressure control valve 81 to be furnished into the first or second pressure receiving chamber 79 or 80 to switch the meter-out flow control valve 4 by causing the meter-in spool 19 to take its first or second position.

It can thus become possible to switch the meter-out flow control valve 4 with the aid of a single meter-out electromagnetic proportional pressure control valve 81.

A thirteenth form of the present invention resides in a directional control valve system according to the first form of the invention described in which both the meter-in and meter-out flow control valves 1 and 4 are operable to effect a switching operation in response to an output pressure of a single hydraulic pilot valve 120 or of a single electromagnetic proportional control valve.

According to the thirteenth form of the invention, it can be seen and should be appreciated that the use of a single hydraulic pilot valve 120 or a single electromagnetic proportional pressure control valve allows switching both the meter-in flow control valve 1 and the meter-out flow control valve 4.

Thus, a simple control system is provided that is operable simply to furnish the first or second chamber of a hydraulic actuator with pressure fluid.

A fourteenth form of the present invention resides in a directional control valve system according to the fourth or fifth form of the invention described which comprises a first and a second electromagnetic proportional control valve 23 and 29 for establishing a first and a second position of the meter-in spool 19 for the said meter-in flow control valve 1, a first electromagnetic proportional pressure control valve 81-1 for establishing a first position of the said meter-out spool 76 or an open state for the poppet 100 of the said first meter-out flow control valve 4-1, and a second electromagnetic proportional pressure control valve 81-2 for establishing a second position of the said meter-out spool 76 or an open state for the poppet 100 of the said second meter-out flow control valve 4-2.

According to the fourteenth form of the invention, it can be seen and should be appreciated that independently of a timing to establish the first or second state for the meter-in spool 19, the meter-out flow control valve 4 is allowed to establish a fluid communication between the first actuator port 72 and the tank port 71 or a fluid communication between the second actuator port 74 and tank port 71.

This permits the first or second actuator port 72 or 74 to be drained of a pressure fluid into a reservoir only after the second or first actuator port 74 or 72 has been supplied with a pressure fluid to develop a predetermined pressure level, or permits a pressure rising timing for the first actuator port 72 to vary from a pressure rising timing for the second actuator port 74.

BEST MODES FOR CARRYING OUT THE INVENTION

Figure 1:
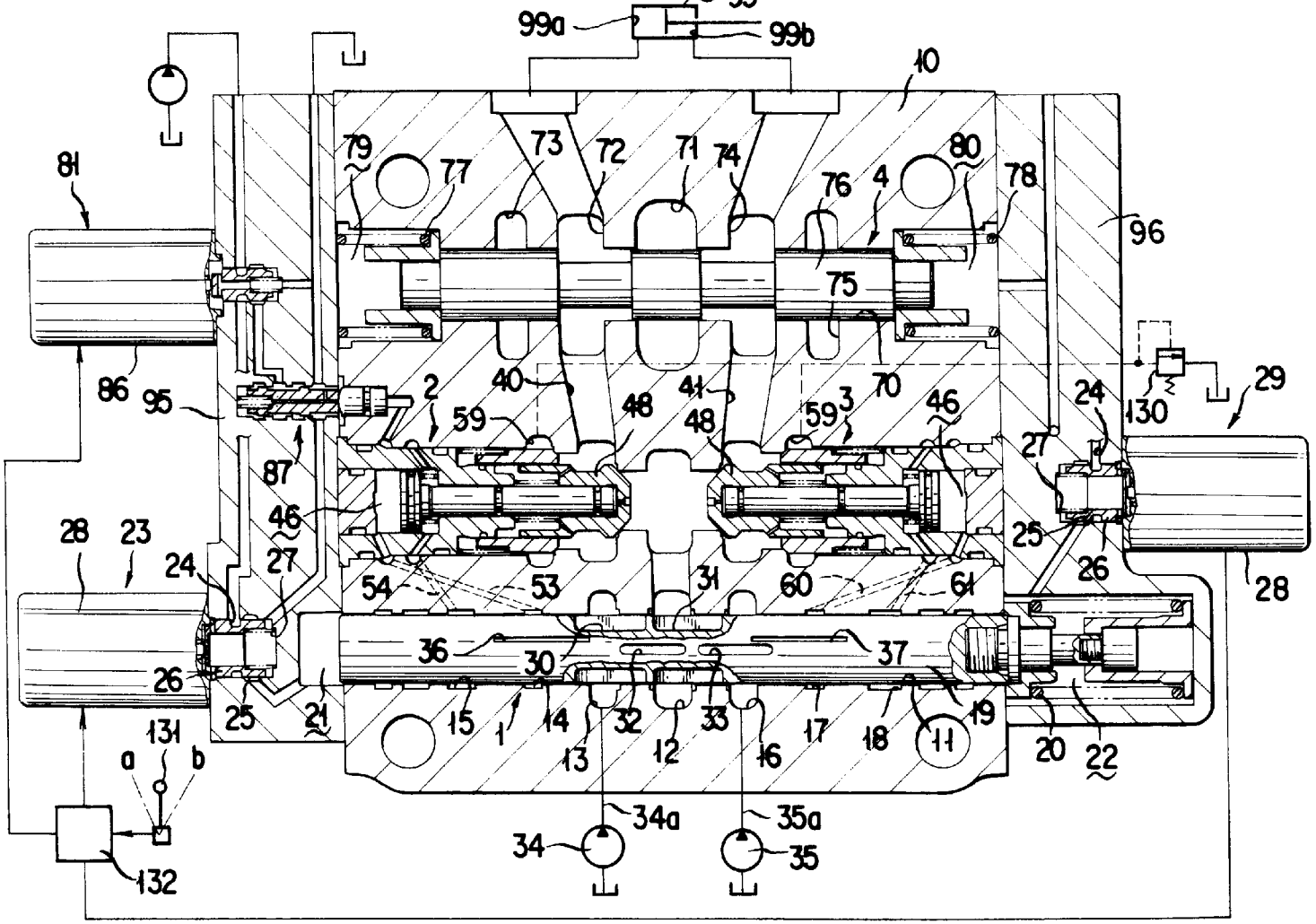
FIG. 1 is an entire cross sectional view showing a a first form of embodiment of the present invention.

As shown in FIG. 1, a directional control valve system is shown to comprise a meter-in flow control valve 1, a first load checking valve 2, a second load checking valve 3 and a meter-out flow control valve 4.

An explanation is first given of a specific structure of each of the valves.

Meter-in Flow Control Valve

Figure 2:
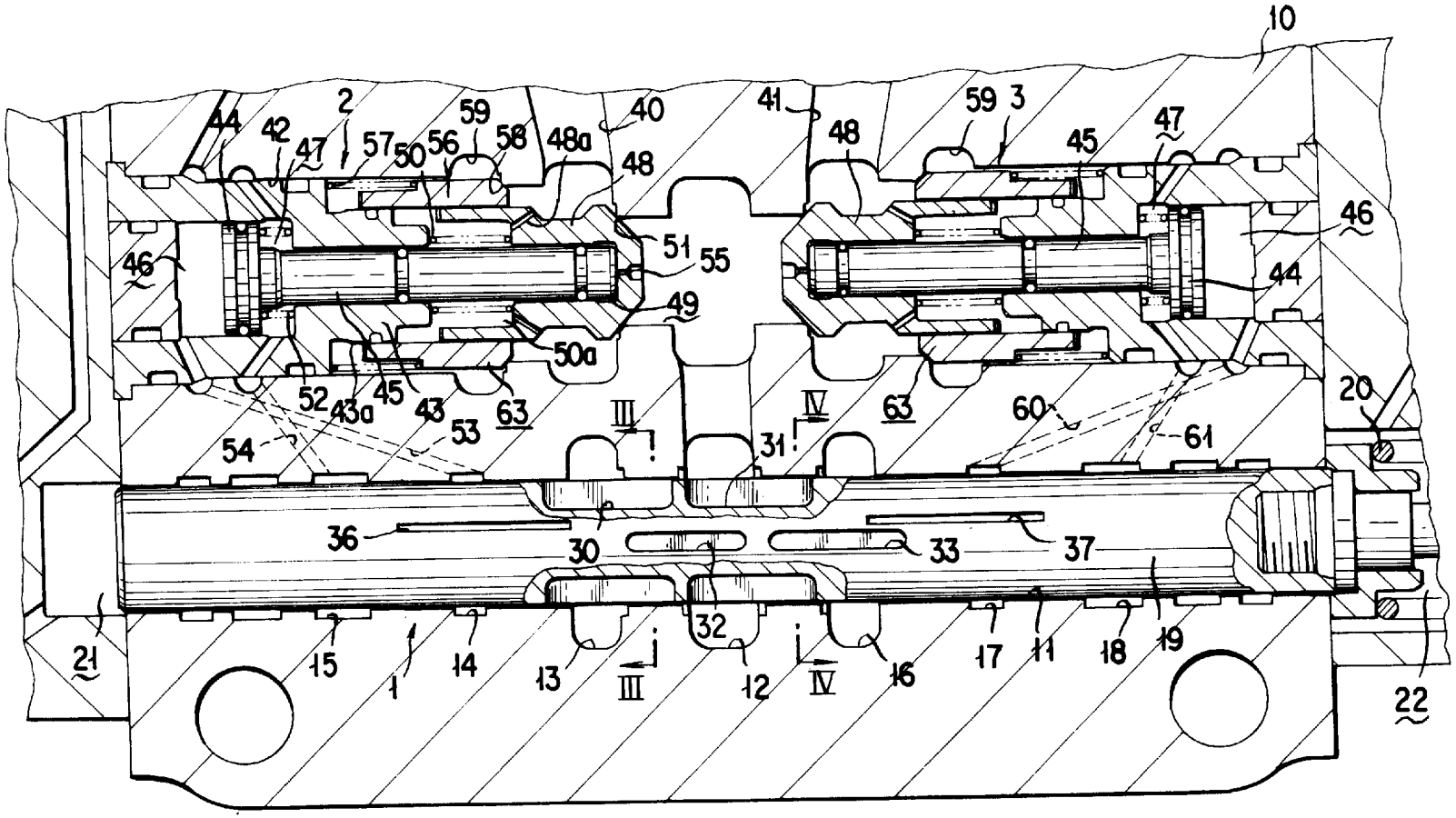
FIG. 2 is an enlarged cross sectional view showing a meter-in flow control valve and a first and a second load checking valve.

As shown in FIGS. 1 and 2, a valve body 10 is formed with a meter-in spool bore 11 and an outlet port 12 that is open to the meter-in spool bore 11. There are also formed on the left hand side of the outlet port 12 a first pump port 13, a first pilot port 14 and a first tank port 15 and on the right hand side of the outlet port 12 a second pump port 16, a second pilot port 17 and a second tank port 18.

A meter-in spool 19 is provided that is arranged to be held at its neutral position by a spring 20. The meter-in spool 19 is adapted to be moved rightwards to take its first position when a first pressure receiving chamber 21 is supplied with pressure fluid and to be moved leftwards to take its second position when a second pressure receiving chamber 22 is supplied with pressure fluid.

The first pressure receiving chamber 21 is supplied with pressure fluid by the action of a first electromagnetic proportional pressure control valve 23 that acts to control a meter-in operation. The first electromagnetic proportional pressure control valve 23 comprises a valve 26 for establishing and blocking fluid communication between an inlet port 24 and an outlet port 25, a spring 27 for holding the valve 26 at its fluid blocking position, and a proportional solenoid 28 for thrusting the valve 26 so that it establishes fluid communication, and is adapted to provide at the outlet port 25 a fluid pressure that is proportional to an amount of electricity passing through the proportional solenoid 28. The outlet port 25 is in fluid communication with the first pressure receiving chamber 21.

The second pressure chamber 22 is supplied with pressure fluid by the action of a second electromagnetic proportional pressure control valve 29 that acts to control a meter-in operation. The second electromagnetic proportional pressure control valve 29 may be so constructed as is the first electromagnetic proportional pressure control valve 23. Its outlet port 25 lies in fluid communication with the second pressure receiving chamber 22.

Figure 3:
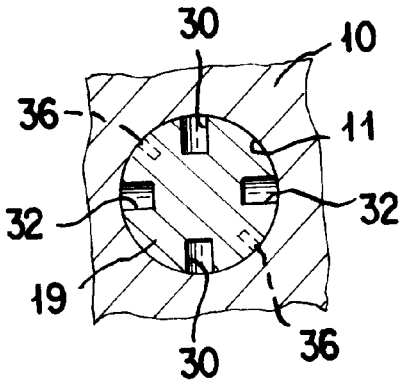
FIG. 3 is a cross sectional view taken along the line III—III in FIG. 2.
Figure 4:
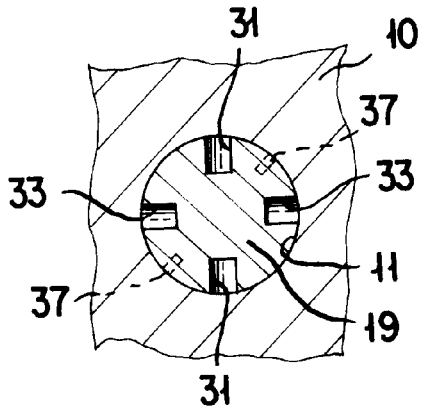
FIG. 4 is a cross sectional view taken along the line IV—IV in FIG. 2.

The meter-in spool 19 is formed with a first and a second main slit channel 30 and 31 and a third and a fourth main slit channel 32 and 33 for establishing and blocking fluid communications between the first and second pump ports 13 and 16 and the outlet port 12, the channels being formed as they are circumferentially deviated in position as shown in FIGS. 3 and 4. The first main slit channel 30 and the second main slit channel 31 are deviated in position longitudinally while the third main slit channel 32 and the fourth main slit channel 33*a* are deviated in position longitudinally.

Figure 6:
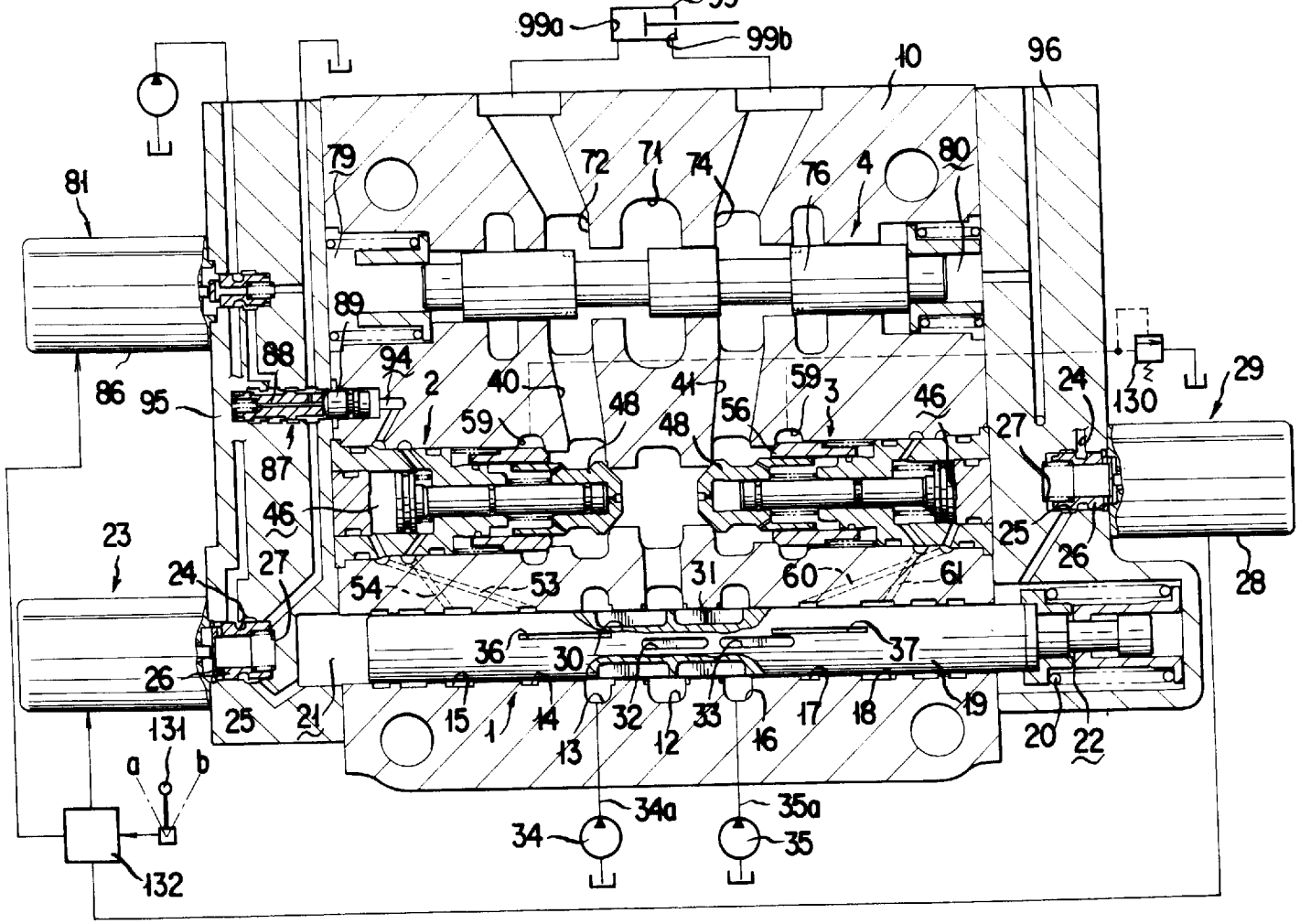
FIG. 6 is a diagrammatic view illustrating an operation in which each spool has its first position.
Figure 7:
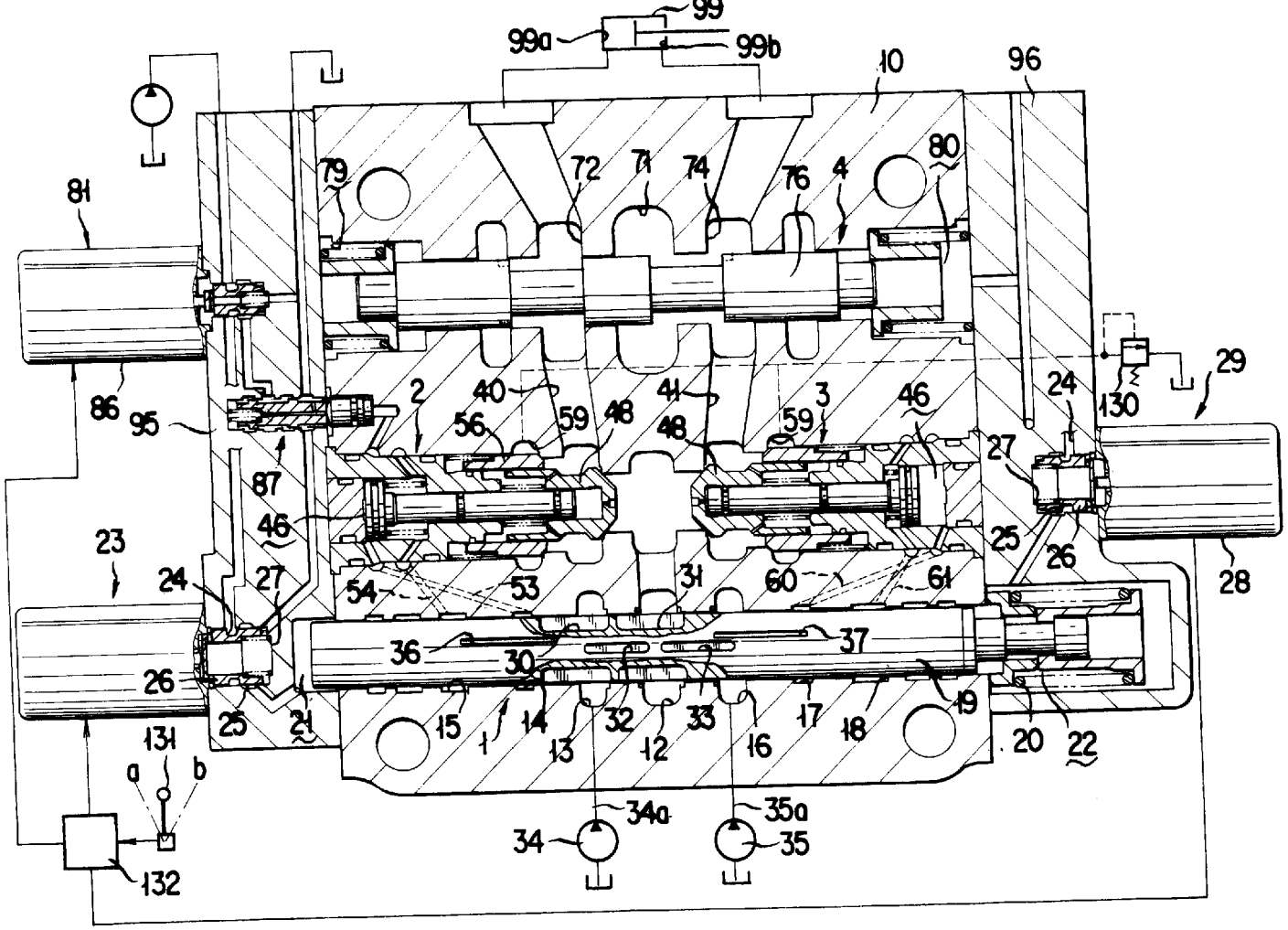
FIG. 7 is a diagrammatic view illustrating an operation in which each spool has its second position.

Holding the meter-in spool 19 at its neutral position as shown in FIG. 1 blocks fluid communication between the first pump port 13, the second pump port 16 and the outlet port 12. Locating the meter-in spool 19 at its first position as shown in FIG. 6 causes the first main slit channel 30 to bring the first pump port 13 and the outlet port 12 into fluid communication with each other and causes the second main slit channel 31 to bring the second pump port 16 and the outlet port 12 into fluid communication with each other. Locating the meter-in spool 19 at its second position as shown in FIG. 7 causes the third main slit channel 32 to bring the first pump port 13 and the outlet port 12 into fluid communication with each other and causes the fourth main slit channel 33 to bring the second pump port 16 and the outlet port 12 into fluid communication with each other.

Bringing the first and second pump ports 13 and 16 into fluid communication with the outlet port 12 by locating the meter-in spool 19 at its first position or second position permits the outlet port 12 to be fed with a fluid flow that is twice as large as using a conventional valve with a meter-in spool 19 having the same diameter and stroke length.

Also, as shown in FIG. 6, the first pump port 13 may be connected to the discharge path 34 of a first hydraulic pump 34 while the second pump port 16 may be connected to the discharge path 35*a* of a second hydraulic pump 35 to allow discharge pressure fluids of the first and the second hydraulic pumps 34 and 35 to be combined and to be fed in a pressure fluid flow into the outlet port 12. In this connection it should also be noted that the discharge pressure fluid from a single hydraulic pump may be supplied into both the first and second pump ports 13 and 16.

The meter-in spool 19 is also formed with a first pilot slit channel 36 and a second pilot slit channel 37. Thus, holding the meter-in spool 19 at its neutral position as shown in FIG. 1 will cause the first pilot slit channel 36 to bring the first pump port 13 and the first pilot port 14 into fluid communication with each other, and will cause the second pilot slit channel 37 to bring the second pump port 16 and the second pilot port 17 into fluid communication with each other.

Locating the meter-in spool 19 at its first position as shown in FIG. 6 will cause the first pilot slit channel 36 to continue to hold the first pump port 13 and the first pilot port 14 in fluid communication and will cause the second pilot slit channel 37 to bring the second pilot port 17 and the second tank port 18 into fluid communication with each other.

Locating the meter-in spool 19 at its second position as shown in FIG. 7 will cause the first pilot slit channel 36 to bring the first pilot port 14 and the first tank port 15 into fluid communication with each other and will cause the second pilot slit channel 37 to bring the second pump port 16 and the second pilot port 17 into fluid communication with each other.

First Load Checking Valve and Second Load Checking Valve

As shown in FIG. 2, the valve body 10 is also formed with a first fluid passage 40 and a second fluid passage 41 that communicate with the outlet port 12. The first fluid passage 40 is provided with a first load checking valve 2 and the second fluid passage 41 is provided with a second load checking valve 3.

Structure of the First Load Checking Valve

A fitting bore 42 formed in the valve body 10 has a sleeve 43 inserted and anchored therein. Inserted into and slidably accommodated in the axial center of the sleeve 43 is a rod 45 having a piston 44, designed to form a large diameter pressure receiving chamber 46 and a small diameter pressure receiving chamber 47. A portion of the rod 45 that projects beyond the sleeve 43 has a poppet valve 48 fitted therein to form a pressure chamber 49, the poppet 48 being held in pressure contact with a main seat 51 by means of a spring 50. The rod 45 is urged by a spring 52 towards the large diameter chamber 46 (i.e., away from the poppet valve 48).

The large diameter chamber 46 communicates through a first bore 53 with the first pilot port-14 whereas the small diameter chamber 47 communicates through a second fluid bore 54 with the first tank port 15. The pressure chamber 49 communicates through a small opening 55 with the outlet port 12.

Fitted over a small diameter area of the sleeve 43 and an outer peripheral surface of the poppet valve 48 is a cylindrical valve 56 that is held in pressure contact with a seat 58 by means of a spring 57, acting to block fluid communication between a relief port 59 and the first fluid passage 40. Thrusted by pressure fluid in the first fluid passage 40, the cylindrical valve 56 also serves to hold fluid communication between the relief port 59 and a first actuator port 72. A relief for a check valve 63 is thus constructed.

Structure of Second Load Checking Valve

The second load checking valve 3 is identically constructed as with the first load checking valve 2, wherein the large diameter chamber 46 communicates through a third fluid bore 60 with the second pilot port 17 and the small diameter chamber 47 communicates through a fourth fluid bore 61 with the second tank port 18.

Meter-out Flow Control Valve

As shown in FIG. 1, the valve main body 10 has a meter-out spool bore 70 that is formed with a tank port 71, a first actuator port 72, a first regenerative port 73, a second actuator port 74 and a second regenerative port 75. A meter-out spool 76 is arranged to be held at its neutral position by a first and a second spring 77 and 78. The meter-out spool 76 is arranged to be movable rightwards with pressure fluid fed into a first pressure receiving chamber 79 to take its first position. The meter-out spool 76 is arranged to be movable leftwards with pressure fluid fed into a second pressure receiving chamber 80 to take its second position.

Holding the meter-out spool 76 at its neutral position will block fluid communication between the ports. Moving the meter-out spool 76 to take its first position will cause the first actuator port 72 to communicate with the tank port 71 and the second actuator port 74 to communicate with the second regenerative port 75. Moving the meter-out spool 76 to take its second position will cause the second actuator port 74 to communicate with the tank port 71 and the first actuator port 72 to communicate with the first regenerative port 73. It should be noted in this connection that holding the meter-out spool 76 at its neutral position may as modified cause the first and second actuator ports 72 and 74 to communicate with the tank port 71 and the first and second regenerative ports 73 and 75 may be omitted.

Figure 5:
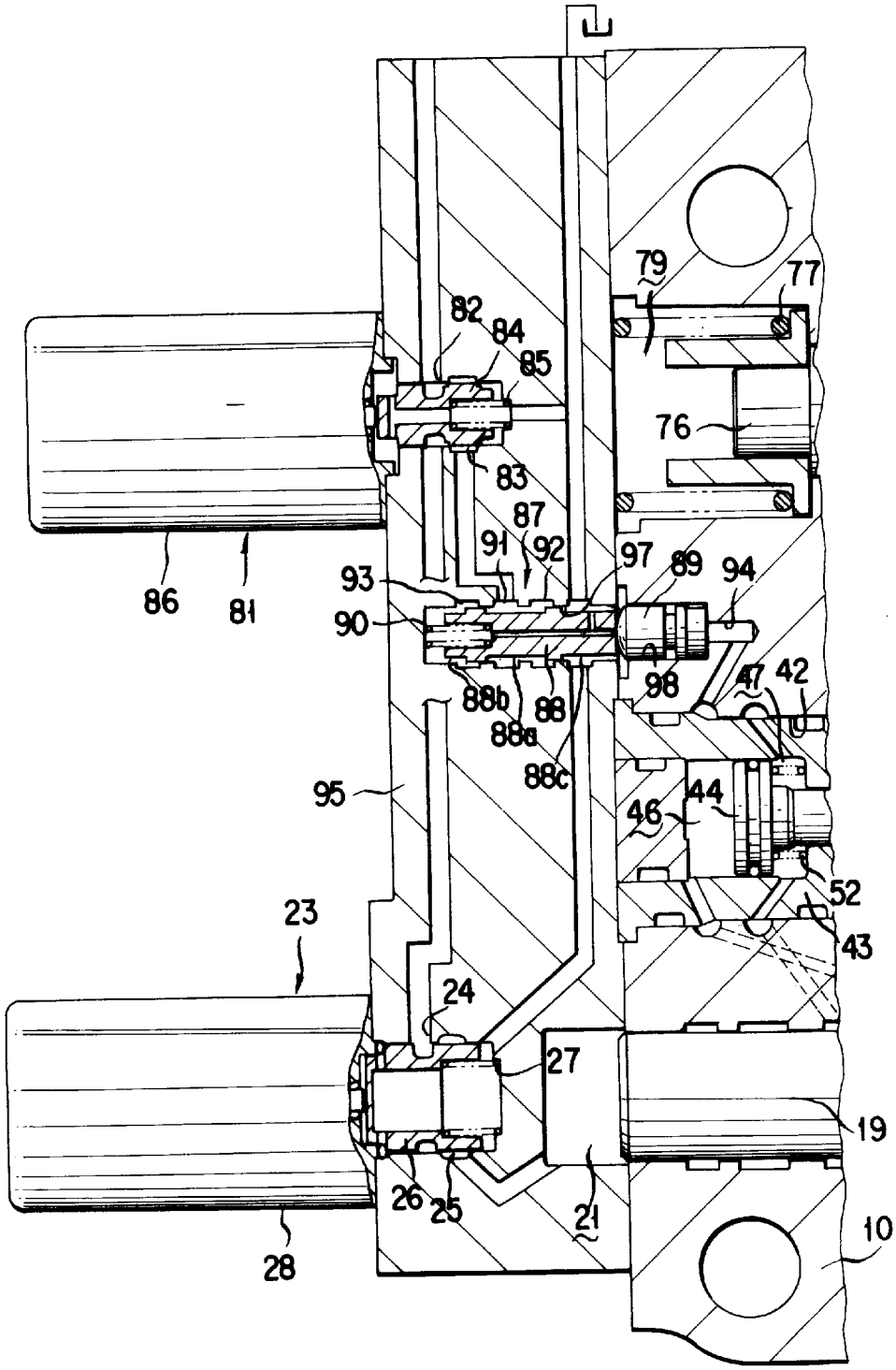
FIG. 5 is a cross sectional view showing a pilot switching valve.

As shown in FIG. 5 the meter-out electromagnetic proportional pressure control valve 81 comprises a spool 84 for establishing and blocking fluid communication between an inlet port 82 and an outlet port 83, a spring 85 for holding the spool 84 at a position to block fluid communication between the inlet port 82 and the outlet port 83, and a proportional solenoid 86 that may thrust the spool 84 to take a position to cause the inlet port 82 and the outlet port 83 to communicate with each other.

The fluid pressure of the outlet port 83 is fed through a pilot switching valve 87 into one of the first and second pressure receiving chambers 79 and 80.

As shown in FIG. 5, the pilot switching valve 87 includes a first and a second spool 88 and 89. The first spool 88 is thrusted by a spring 90 to take its first position, allowing an inflow port 91 to communicate through a first small diameter area 88a with a first outflow port 92, and a second outflow port 93 through a second small diameter area 88b with a tank port. The second spool 89 is then pushed to move by the first spool 88. The second spool 89 is thrusted by pressure fluid in a pressure chamber 94 to move the first spool 88 to locate it at its second position, permitting the inflow port 91 through the first small diameter area 88*a* with the second outflow area 93 and the first outflow port 92 through a third small diameter area with the tank port.

There lie in fluid communication the inflow port 91 with the outlet port 83, the first outflow port 92 with the second pressure receiving chamber 80, the second outflow port 93 with the first pressure receiving chamber 79, and the pressure chamber 94 with the large diameter chamber 46 of the load checking valve 2, i. e., with the pilot port 14.

Each of the above mentioned electromagnetic proportional pressure control valves is attached to a first cover 95 and a second cover 96 which are in turn attached to the valve body 10. The first spool 88 of the pilot switching valve 87 is slidably received in a spool bore 97 in the first cover 95 while its second spool 89 is slidably received in a spool bore 98 in the valve body 10.

The first actuator port 72 connects to a first chamber 99*a* of a hydraulic actuator 99 and the second actuator port 74 connects to a second chamber 99*b* thereof.

An explanation will now be given of operations of the system.

Where None of the Electromagnetic Proportional Pressure Control Valves 23, 29 and 81 are Actuated:

Both the meter-in and meter-out spools 19 and 76 are held at their neutral positions as shown in FIG. 1. If the first and second hydraulic pumps 34 and 35 are at a halt, pushing the poppet valve 48 against the main seat 51 with pressure applied via the narrow opening 48*a* into the spring chamber 50*a* will hold the first load checking valve 2 in a closed state under a hold-on pressure in the first chamber 99*a* of the hydraulic actuator 99 while holding that high hold-on pressure against leakage. The second load checking valve 3 will likewise be held in a closed state under a hold-on pressure in the second chamber 99*b* of the hydraulic actuator 99 while holding that high hold-on pressure against leakage.

If the first and second hydraulic pumps 34 and 35 are being driven, pressure fluid admitted into the first pump port 13 will flow through the first pilot slit channel 36, the first pilot port 14 and the first fluid bore 53 into the large diameter chamber 46 to move the piston 44 and Let hence the rod 45 rightwards and thus to push the poppet valve 48 against the first seat 51. The first load checking valve 2 is thus held in a closed state. Pressure fluid admitted into the second pump port 16 will also flow into the large diameter chamber 46 to push the poppet valve 48 against the main seat 51, thereby holding the second load checking valve 3 closed.

Where the First Meter-in Electromagnetic Proportional Pressure Control Valve 23 and the Meter-out Electromagnetic Proportional Pressure Control Valve 81 are Actuated Referring to FIG. 6, pressure fluid will flow into the first pressure receiving chamber 21 of the meter-in flow control valve 1 to move the meter-in spool 19 until it reaches its first position. Pressure fluid in the pressure chamber 94 will move the first spool 88 of the pilot switching valve 87 until it reaches its second position. Then, output pressure fluid of the meter-in electromagnetic proportional pressure control valve 81 will flow through the first outflow port 93 into the first pressure receiving chamber 79 of the meter-out flow control valve 4 to move the meter-out spool 76 until it reaches its second position.

This will cause the first load checking valve 2 into a closed state in a manner as described previously. Then, the large diameter chamber 46 of the second load checking valve 3 will communicate through the third fluid bore 60, the second pilot port 17, the second pilot slit channel 37 and the second tank port 18 with the reservoir tank. Urged by the spring 52 the piston 44, and hence the rod 45 will thus be moved away from the poppet valve 48 to cause the second load checking valve 3 into an open state in which the poppet valve 48 operates to be open with pressure fluid in the outlet port 12.

On the other hand, the first actuator port 72 in the meter-out flow control valve 4 will communicate with the tank port 71.

Consequently, pressure fluid in the outlet port 12 will push the poppet valve 48 of the second load checking valve 3 to move it away from the main seat 51 and will flow through the second fluid passage 41 and the second actuator port 74 into the second chamber 99*b* of the hydraulic actuator 99. Pressure fluid in the first chamber 99*a* will then flow out through the first actuator port 72 and the tank port 71 into the reservoir tank.

It can also be seen that moving the meter-in spool 19 from its neutral position towards its first position will establish fluid communication first between the second pilot slit channel 37 and the second tank port 18 and subsequently between the first and second pump ports 13, 16 and the outlet port 12.

Thus, since the second load checking valve 3 has previously turned into an open state when pressure fluid flows into the outlet port 12, the pressure fluid will not be stopped there. The same applies if fluid communication between the first and second pump ports 13, 16 and the outlet port 12 and fluid communication between the second pilot slit channel 37 and the second tank port 18 are allowed to occur concurrently.

Where the Meter-in Second Electromagnetic Proportional Pressure Control Valve 29 and the Meter-out Electromagnetic Proportional Pressure Control Valve 81 are Actuated With pressure fluid flowing into the second pressure receiving chamber 22 in the meter-in flow control valve 1, the meter-in spool 19 will be moved to take its second position as shown in FIG. 7. The first spool 88 in the pilot switching valve 87 will be biased by the spring 90 to take its first position to permit the output pressure fluid of the meter-out electromagnetic proportional pressure control valve 81 to flow through the first outflow port 92 into the second pressure receiving chamber 80 in the meter-out flow control valve 4, thereby causing the meter-out spool 76 to take its second position.

This will cause the second load checking valve 3 to take an open state as described above. Then, the large diameter chamber 46 in the first load checking valve 2 will communicate through the first fluid bore 53, the first pilot port 14, the first pilot slit channel 36 and the first tank port 15 with the reservoir tank. Urged by the spring 52, the piston 44, and hence the rod 45, will thus be moved away from the poppet valve 48 to cause the first load checking valve 2 to take an open state in which the poppet valve 48 operates to be open with pressure fluid in the outlet port 12.

On the other hand, the second actuator port 74 in the meter-out flow control valve 4 will communicate with the tank port 71.

Consequently, pressure fluid in the outlet port 12 will push the poppet valve 48 of the first load checking valve 2 to move it away from the main seat 51 and will flow through the first fluid passage 40 and the first actuator port 72 into the first chamber 99*a* of the hydraulic actuator 99. Pressure fluid in the second chamber 99*b* will then flow out through the second actuator port 74 and the tank port 71 into the reservoir tank.

It can also be seen that moving the meter-in spool 19 from its neutral position towards its second position will establish fluid communication first between the first pilot slit channel 36 and the first tank port 15 and subsequently between the first and second pump ports 13, 16 and the outlet port 12.

Thus, since the first load checking valve 2 has previously turned into an open state when pressure fluid flows into the outlet port 12, the pressure fluid will not be stopped there. The same applies if fluid communication between the first and second pump ports 13, 16 and the outlet port 12 and fluid communication between the first pilot slit channel 36 and the first tank port 15 are allowed to occur concurrently.

In an operation as described, it should be noted that pressure fluid in the first actuator port 72 or the second actuator port 74 which serves to push the cylindrical valve 56 acts through the relief port 59 on the relief valve 130 and, when its pressure becomes higher than a preset pressure for the relief valve 130, effects a relief operation.

It should also be noted that since pressure fluid in the relief port 59 acts to bring the cylindrical valve 56 into pressure contact with the seat 58 to block fluid communication the first, second actuator port 72, 74 and the relief port 59, pressure fluid in the relief port 59 is prevented from flowing into the first, second actuator port 72, 74.

Thus, abnormal pressure rise in the first, second actuator port 72, 74 can effectively be prevented by the relief valve 130.

An explanation will next be given of a control system for each of the electromagnetic proportional pressure control valves described.

Referring to FIG. 1, operating an operator lever 131 with a first position a, a second position b provides furnishing a controller 132 with a first signal, a second signal. Furnished with the first signal, the controller 132 will cause the proportional solenoid 28 of the first electromagnetic proportional pressure control valve 23 to be electrically energized, and the proportional solenoid 86 of the electromagnetic proportional pressure control valve 81 to be electrically energized at a preset timing.

Furnished with the second signal, the controller 132 will cause the proportional solenoid 28 of the second electromagnetic proportional pressure control valve 29 to be electrically energized, and the proportional solenoid 86 of the electromagnetic proportional pressure control valve 81 to be electrically energized at a preset timing.

An explanation will next be given of a second form of embodiment of the meter-out flow control valve 4.

Figure 8:
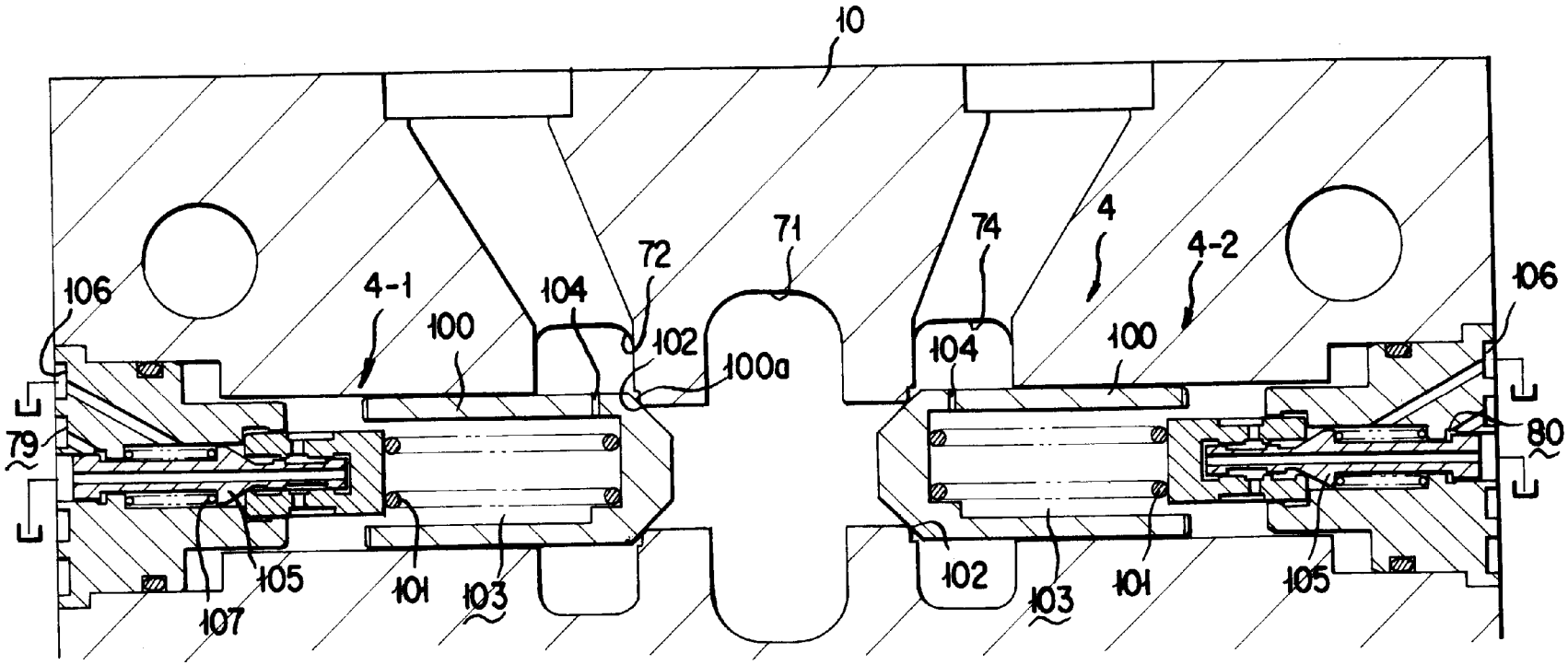
FIG. 8 is a cross sectional view showing a second form of embodiment of the meter-out flow control valve.

Referring to FIG. 8, the meter-out flow control valve 4 is shown to comprise a first meter-out flow control valve 4-1 and a second meter-out flow control valve 4-2.

The first meter-out flow control valve 4-1 has a poppet valve 100 urged by a spring 101 into a pressure contact with a seat 102 to block fluid communication between the first actuator port 72 and the tank port 71. The poppet 100 has a spring chamber 103 that communicates through a constriction 104 with the first actuator port 72. An auxiliary poppet valve 105 is provided to establish and block fluid communication of the spring chamber 103 with a tank port 106.

Urged by an auxiliary spring 107, the auxiliary poppet valve 105 is arranged to take its blocking position. The auxiliary poppet valve 105 is movable by pressure fluid in the first pressure receiving chamber 79 to take its communication position.

With the first meter-out flow control valve 4-1 so arranged, in the absence of pressure fluid flowing into the first pressure receiving chamber 79 fluid communication between the spring chamber 103 and the tank port 106 will be blocked. Then, pressure in the spring chamber 103 becoming identical to pressure in the actuator port 72, the poppet valve 100 will be pushed by the spring 101 against the seat 102 to take a closed state.

Consequently, a hold-on pressure admitted into the first actuator port 72 will, by acting to hold the poppet valve 100 closed, not leak into the tank port 71.

Pressure fluid flowing into the first pressure receiving chamber 79 will cause the auxiliary poppet valve 105 to move to take its fluid communication position, thus permitting the spring chamber 103 to communicate with the tank port 106. Pressure fluid in the first actuator port 72 will then be allowed to flow through the constriction 104 and the spring chamber 103 into the tank port 106 so that pressure in the spring chamber 103 may become lower than pressure in the first actuator port 72.

This will cause the poppet valve 100 under the pressure in the first actuator port 72 acting on its pressure receiving area 100*a* to move away from the seat 102, permitting the first actuator port 72 to communicate with the tank port 71. The area of this fluid communication will be proportional to the moving distance of the auxiliary poppet valve 105 and hence to the pressure in the first pressure receiving chamber 79.

It can also be seen that pressure in the tank port 71 becoming greater than pressure in the first actuator port 72 will cause the poppet valve 100 to move against the spring 101 and to move away from the seat 102. Then, when the pressure in the first actuator port 72 becomes negative, the poppet valve 100 will be open and will be capable of sucking pressure fluid from the tank port 71, thus functioning as an intake or suction valve. Also, the poppet valve 100 being of a cone seat type will, at its neutral position, prevent in principle pressure fluid flow from the first, second actuator port 72, 74 into the tank port 71.

It should be noted that the second meter-out flow control valve 4-2 is identical in structure to the first meter-out flow control valve 4-1.

Figure 9:
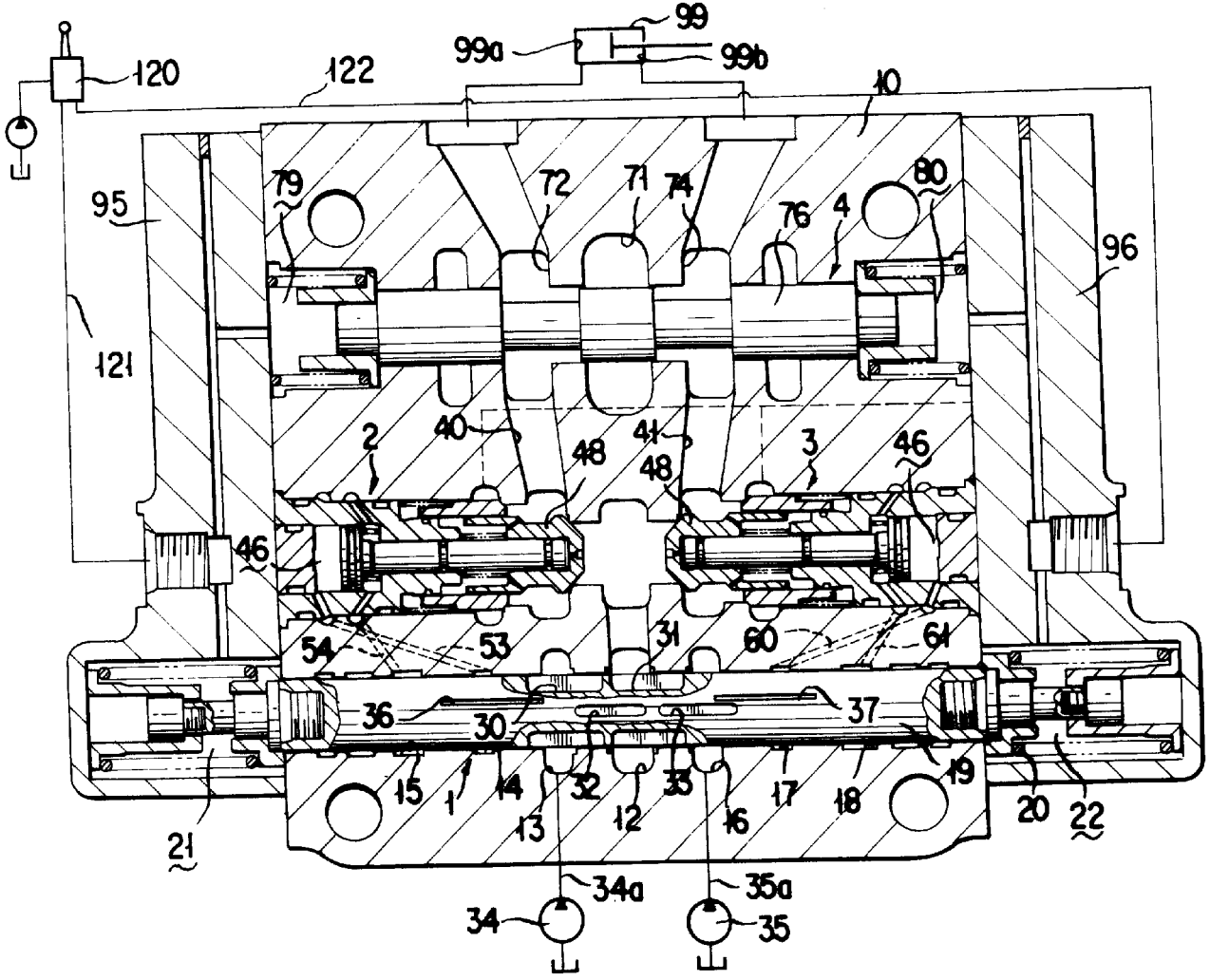
FIG. 9 is a cross sectional view showing a second form of embodiment of the present invention.

FIG. 9 shows a second form of embodiment of the present invention in which a hydraulic pilot valve 120 has a first output circuit 121 connected to each of the first pressure receiving chambers 21 and 79 and a second output circuit 122 connected to each of the second pressure receiving chambers 22 and 80. It should be noted that in lieu of the hydraulic pilot valve 120 an electromagnetic proportional pressure control valve may be used.

In the arrangement shown in FIG. 9, it can be seen that furnishing pressure fluid into the first output circuit 121 by operating the hydraulic valve 120 will move both the meter-in spool 19 and the meter-out spool 76 to take their respective first positions. Furnishing pressure fluid into the second output circuit 122 will move both the meter-in spool 19 and the meter-out spool 76 to take their respective second positions.

Figure 10:
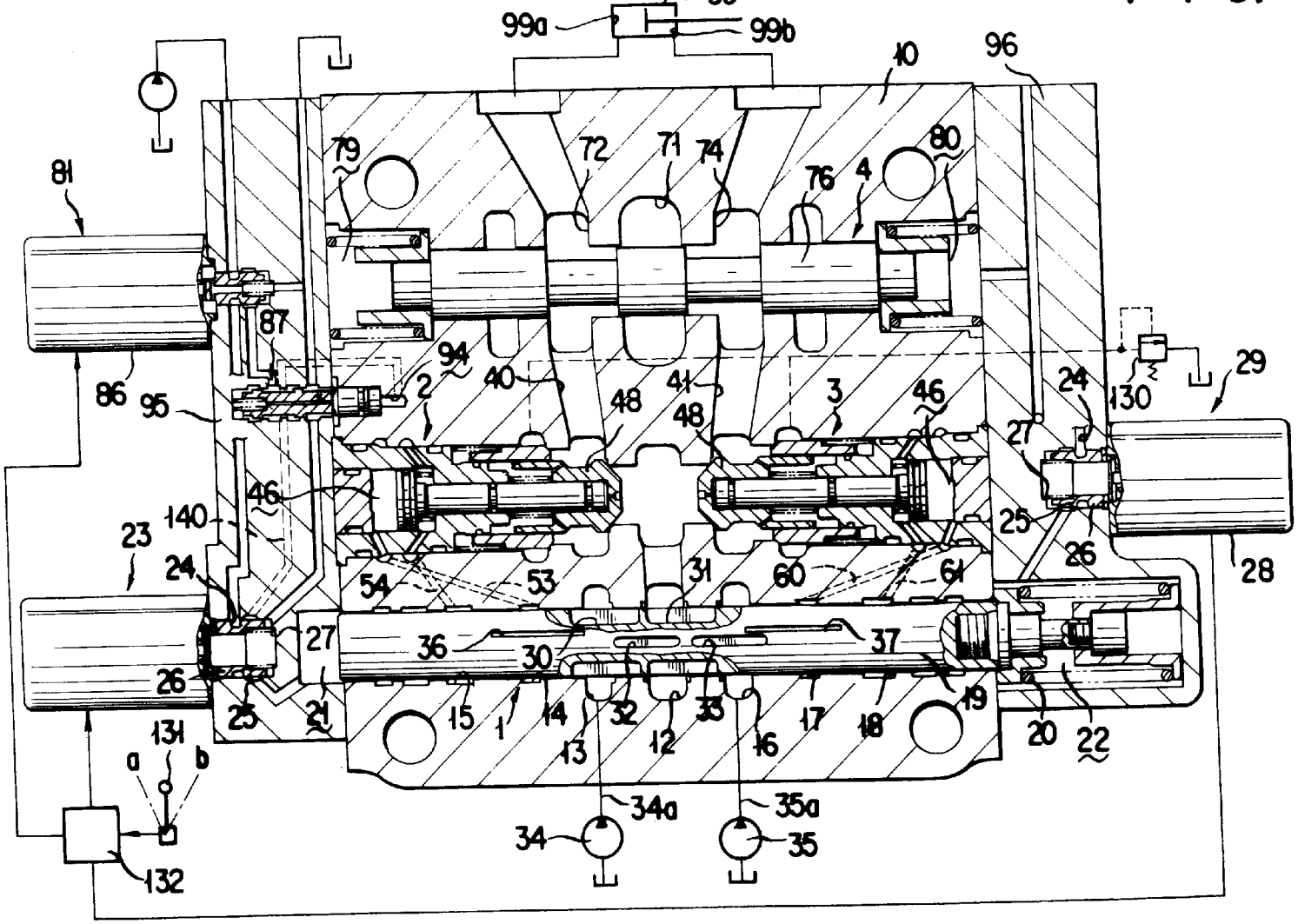
FIG. 10 is a cross sectional view showing a third form of embodiment of the present invention.

FIG. 10 shows a third form of embodiment of the present invention in which the outlet port 25 of the first electromagnetic proportional pressure control valve 23 is arranged to communicate through a fluid bore 140 with the pressure chamber 94 of the pilot switching valve 87.

In the arrangement shown in FIG. 10, it can be seen that furnishing pressure fluid from the first electromagnetic proportional pressure control valve 23 into the first pressure receiving chamber 21 of the meter-in spool 19 will permit pressure fluid to be furnished also into the pressure chamber 94 to move the first spool 88 of the pilot switching valve 87 to take its second position and will also permit pressure fluid to be furnished further into the first pressure receiving chamber 79 of the meter-out spool 76 to move the meter-in spool 19 to take its first position and to move the meter-out spool 76 to take its first position.

Figure 11:
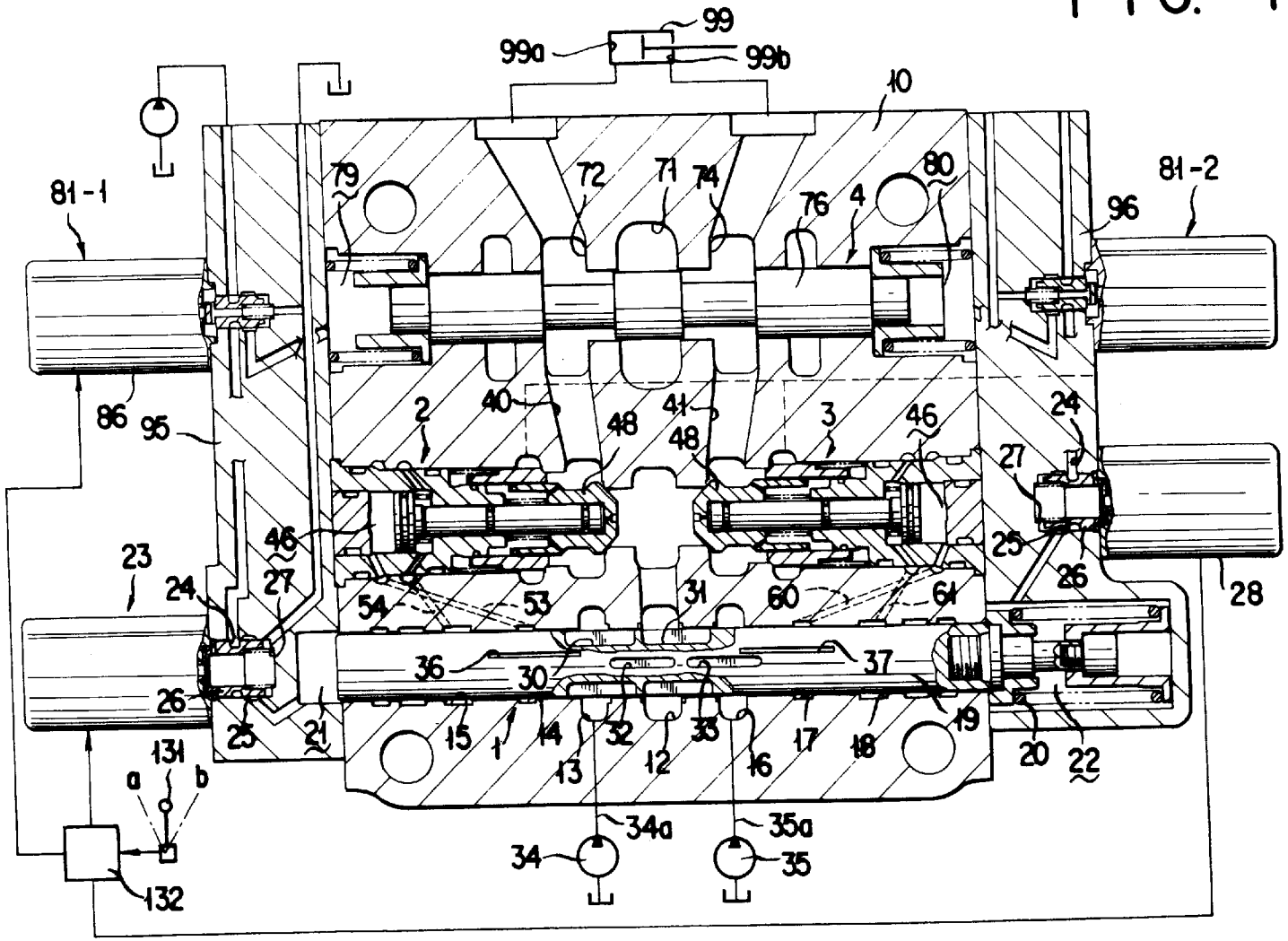
FIG. 11 is a cross sectional view showing a fourth form of embodiment of the present invention.

FIG. 11 shows a fourth form of embodiment of the present invention in which the first pressure receiving chamber 79 of the meter-out spool 76 is arranged to be supplied with pressure fluid by the first electromagnetic proportional pressure control valve 81-1 and its second pressure receiving chamber 80 is arranged to be supplied with pressure fluid by the electromagnetic proportional pressure control valve 81-2.

This arrangement permits a switching operation for the meter-in spool 19 and a switching operation for the meter-out flow control valve 4 to be performed at any timing as desired.

Figure 12:
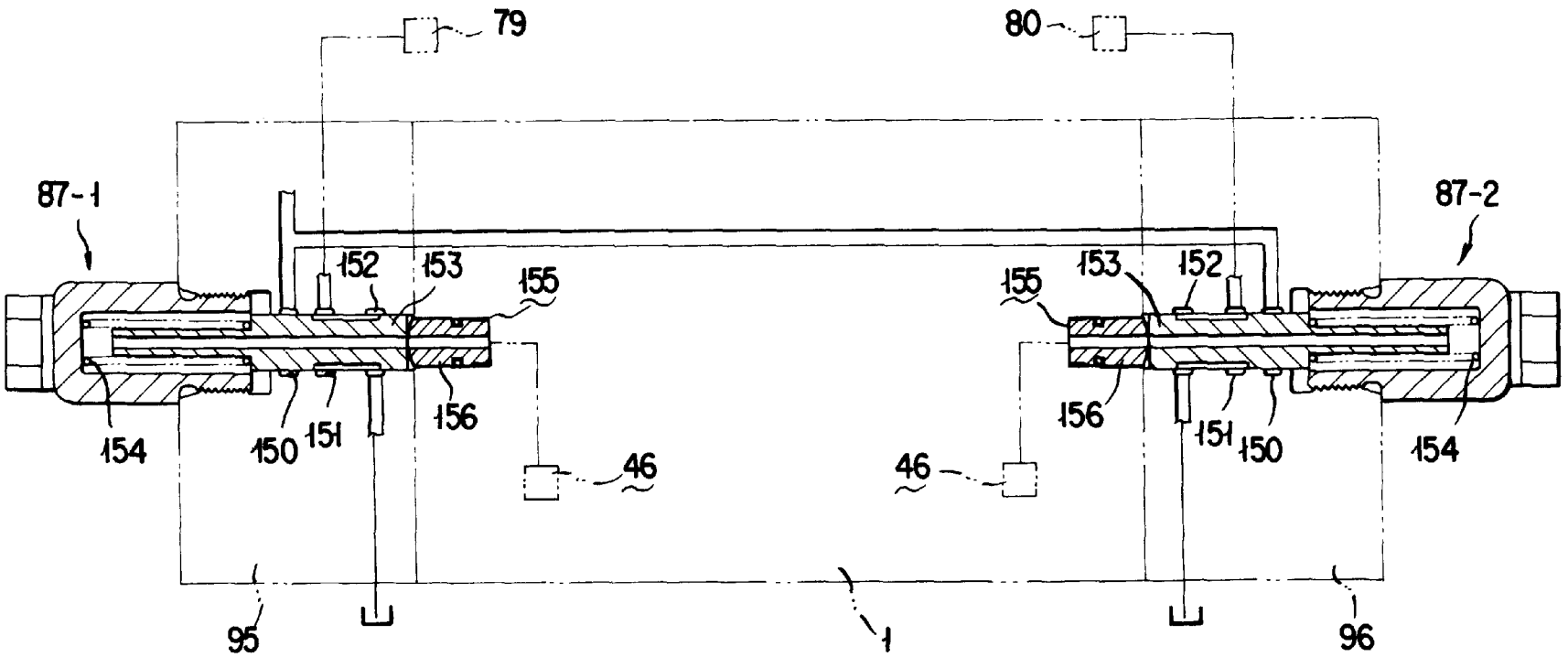
FIG. 12 is a second form of embodiment of the pilot switching valve.

FIG. 12 shows a form of embodiment for switching the meter-out flow control valve 4. In this embodiment, a first pilot switching valve 87-1 is used to allow the first pressure receiving chamber 79 to communicate with one of the fluid pressure source and the reservoir tank selectively and a second pilot switching valve 87-2 is used to allow the second pressure receiving chamber 80 to communicate with one of the fluid pressure source and the reservoir tank selectively.

The first pilot switching valve 87-1 is shown to comprise a first spool 153 for establishing and blocking fluid communications between an inflow port 150 and an outflow port 151 and a tank port 152, a spring 154 for urging-the first spool 153 to take its first position, and a second spool 156 thrustable by pressure in a pressure chamber 155 to locate the first spool 153 at its second position.

There can be established fluid communication of the inflow port 150 with a fluid pressure source, e. g., an output side of the electromagnetic proportional pressure control valve 81 and fluid communication of the outflow port 151 with the first pressure chamber 79. The pressure chamber 155 may be supplied with a pressure fluid for locating the spool 19 of the meter-in flow control valve 1 at its first position, e.g., pressure fluid that is supplied into the large diameter chamber 46 of the first load checking valve 2, output pressure fluid from the first meter-in electromagnetic proportional pressure control valve 23, output pressure fluid from the hydraulic pilot valve, output pressure fluid from a switching valve that is switched to operate with the output pressure fluid from the meter-in first electromagnetic proportional pressure control valve 23 and so forth.

The second pilot valve 87-2 is identical in structure to the first pilot switching valve 87-1. In the second pilot valve 87-2, there can be established fluid communication of the inflow port 150 with a fluid pressure source, e.g., an output side of the electromagnetic proportional pressure control valve 81, and fluid communication of the outflow port 151 with the second pressure chamber 80. The pressure chamber 155 may be supplied with a pressure fluid for locating the spool 19 of the meter-in flow control valve 1 at its second position, e. g., pressure fluid that is supplied into the large diameter chamber 64 of the second load checking valve 3, output pressure fluid from the second meter-in electromagnetic proportional pressure control valve 29, output pressure fluid from a switching valve that is switched to operate with the output pressure fluid from the second meter-in electromagnetic proportional pressure control valve 29 and so forth.

Figure 13:
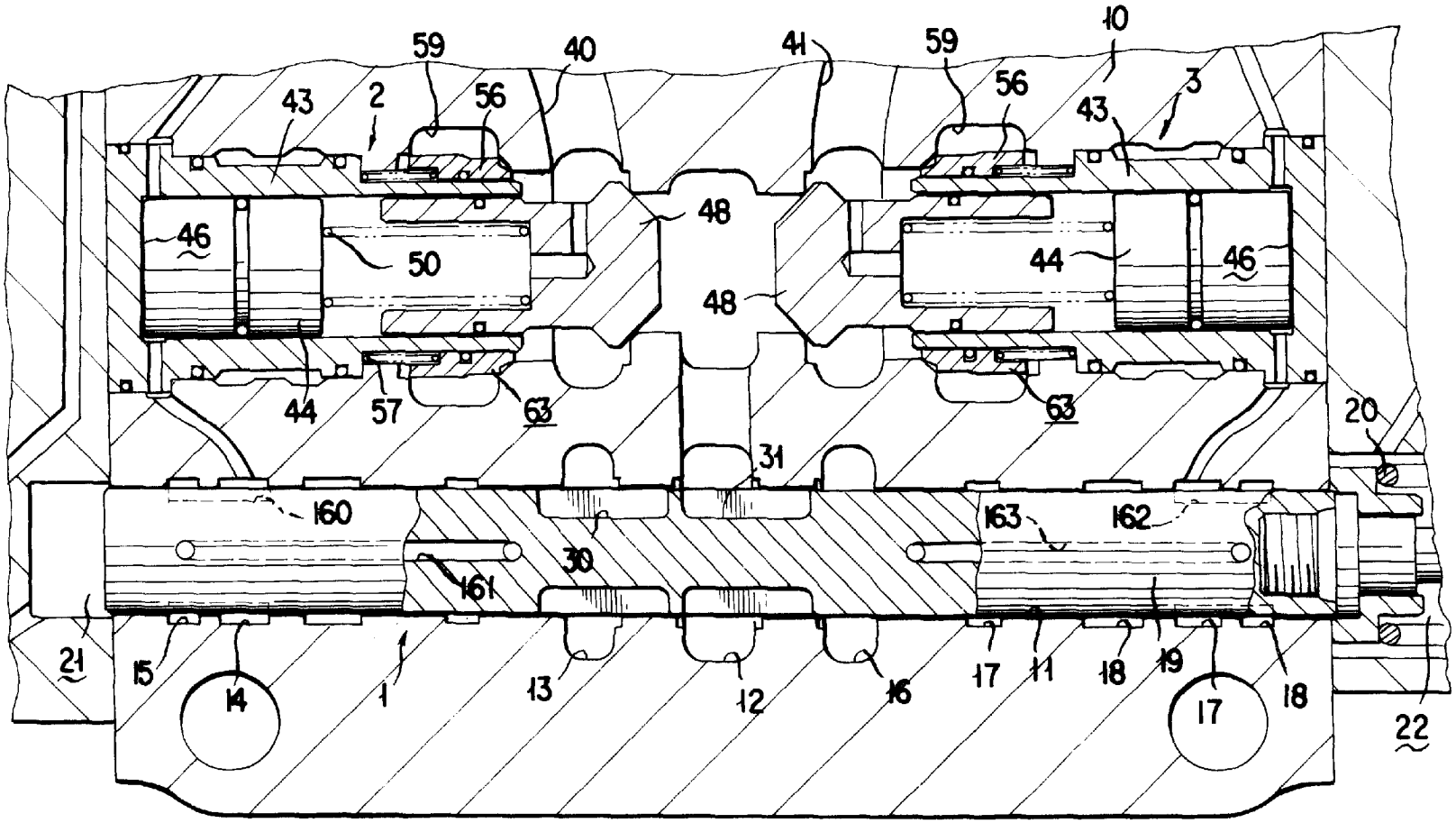
FIG. 13 is a diagrammatic view showing a second form of the first and second load checking valves.

FIG. 13 shows another form of embodiment constituting the first and second load checking valves 2 and 3 in which the piston 44 is slidably received in the sleeve 43 to form the large diameter chamber (pressure receiving area) 46. The pressure receiving chamber 46 of the first load checking valve 2 is arranged to communicate through the first pilot port 14 and a slit channel 160 with the first tank port 15 when the spool 19 of the meter-in flow control valve 1 lies at its neutral position. When the spool 19 lies at its first position, fluid communication between the large diameter chamber 64 and the first tank port 15 is arranged to be blocked while permitting the first pump port 13 and the large diameter chamber 46 to communicate with each other via a fluid bore 161 extending along an axial center of the spool and the first pilot port 14.

The large diameter chamber 64 of the second load checking valve 3 is arranged to communicate through the second pilot port 17 and a slit channel 162 with the second tank port 18 when the spool 19 of the meter-in flow control valve 1 lies at its neutral position. When the spool 19 lies at its second position, fluid communication between the large diameter chamber 64 and the second tank port 18 is arranged to be blocked while permitting the second pump port 16 and the large diameter chamber 46 to communicate with each other via a fluid bore 163 extending along an axial center of the spool and the second pilot port 17.

Figure 14:
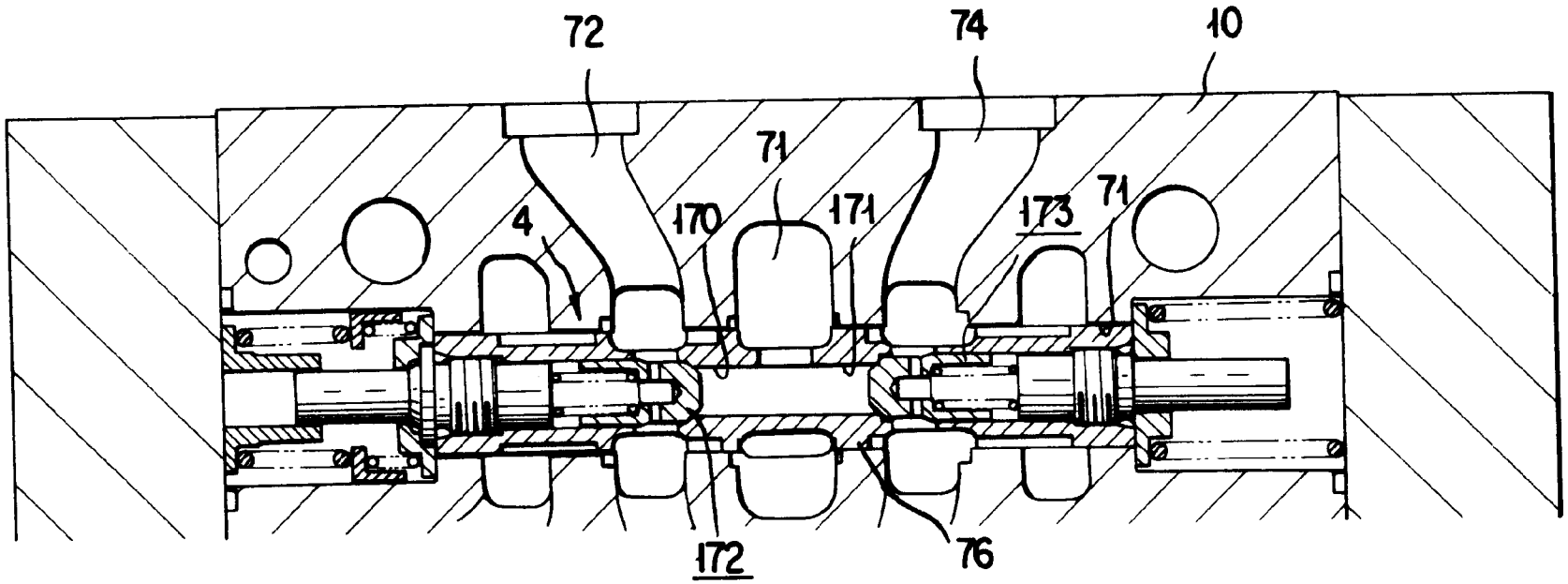
FIG. 14 is a cross sectional view showing a third form of embodiment of the meter-out flow control valve.

FIG. 14 shows another form of embodiment of the meter-out flow control valve 4. In this form of embodiment, the spool 76 is formed therein with a first fluid bore 170 for permitting the drain port 71 and the first actuator port 72 to communicate with each other and a second fluid bore 171 for permitting the drain port 72 and the second actuator port 74 to communicate with each other. The first fluid bore 170 is provided therein with a first checking valve 172 and the second fluid bore 171 is provided therein with a second checking valve 173.

In the arrangement shown in FIG. 14, when pressure in the-first actuator port 72 is higher than pressure in the drain port 71, the first checking valve 172 will be closed, preventing pressure fluid in the first actuator port 72 from flowing into the drain port 71. When pressure in the first actuator port 72 is lower than pressure in the drain port 71, the first checking valve 172 will be open, permitting pressure in the drain port 71 to flow into the first actuator port 72, thus preventing development of a negative pressure in the first actuator port 72.

When pressure in the second actuator port 74 is higher than pressure in the drain port 71, the second checking valve 173 will be closed, preventing pressure fluid in the second actuator port 74 from flowing into the drain port 71. It can also be seen that when pressure in the second actuator port 74 is lower than pressure in the drain port 71, the second checking valve 173 will be open, permitting pressure in the drain port 71 to flow into the second actuator port 74, thus preventing development of a negative pressure in the second actuator port 74.

The meter-out flow control valve 4 shown in FIG. 14 is thus a spool-type meter-in -flow control valve provided with an intake or suction function.

What is claimed is:

1. A directional control valve system, characterized in that it comprises:

a meter-in flow control valve 1 for establishing and blocking fluid communication of a pump port with a single outlet port 12;

a first load checking valve 2 disposed between said outlet port 12 and a first actuator port 72 and adapted to be held in a closed state in response to an external signal;

a second load checking valve 3 disposed between said outlet port 12 and a second actuator port 74 and adapted to be held in a closed state in response to an external signal; and a meter-out flow control valve 4 for establishing fluid communication of one of said first actuator port 72 and said second actuator port 74 with a tank port 71, in which:

coaxially with said first checking valve 2 there is disposed a relief for a check valve 63 for permitting fluid flow from the first actuator port 72 into a relief port 59, and coaxially with said second load checking valve 3 there is disposed a relief for a check valve 63 for permitting fluid flow from the second actuator port 74 into a relief port 59, said relief ports 59 being connected to a single relief valve 130.

2. A directional control valve system, characterized in that it comprises:

a meter-in flow control valve 1 constructed:

to include an outlet port 12, a first pump port 13, a second pump port 16 and a meter-in spool 19 and to be operable to block fluid communication between the ports when the meter-in spool 19 is located at a neutral position thereof and to be operable to establish fluid communication for each of the ports when the meter-in spool 19 is located at a first position that is on one side of the neutral position as well as when the meter-in spool 19 is located at a second position that is on the other side of the neutral position, a first load checking valve 2 disposed between said outlet port 12 and a first actuator port 72 and adapted to be held in a closed state in response to an external signal;

a second load checking valve 3 disposed between said outlet port 12 and a second actuator port 74 and adapted to be held in a closed state in response to an external signal; and a meter-out flow control valve 4 for establishing fluid communication of one of said first actuator port 72 and said second actuator port 74 with a tank port 71, in which:

coaxially with said first checking valve 2 there is disposed the relief for the check valve 63 for permitting fluid flow from the first actuator port 72 into a relief port 59, and coaxially with said second load checking valve 3 there is disposed the relief for the check valve 63 for permitting fluid flow from the second actuator port 74 into a relief port 59, said relief ports 59 being connected to a single relief valve 130.

3. A directional control valve system as set forth in claim 1 or claim 2 in which: said meter-out flow control valve 4 is adapted:

to block fluid communication for each of the ports when a meter-out spool 76 lies at the neutral position and to establish fluid communication of the first actuator port 72 with the tank port 71 when the meter-out spool 76 lies at said first position and to establish fluid communication of the second actuator port 74 with the tank port 71 when the meter-out spool 76 lies at said second position.

4. A directional control valve system as set forth in claim 3, comprising:

a first meter-in electromagnetic proportional control valve 23 causing a meter-in spool 19 for said meter-in flow control valve 1 to assume its first position, a second meter-in electromagnetic valve 29 causing the meter-in spool 19 to assume its second position, a meter-out electromagnetic proportional pressure control valve 81, and a pilot switching valve 87 for switching an output pressure of said electromagnetic proportional pressure control valve 81 over a first and a second switchover pressure, for switching the meter-out flow control valve 4, in which said pilot switching valve 87 is adapted to be operatively switched with a fluid for holding the first load checking valve 2 in a closed state.

5. A directional control valve system, comprising:

a meter-in flow control valve 1 constructed: to include an outlet port 12, a first pump port 13, a second pump port 16 and a meter-in spool 19 and to be operable to block fluid communication between the ports when the meter-in spool 19 is located at a neutral position thereof and to be operable to establish fluid communication between the ports when the meter-in spool 19 is located at a first position that is on one side of the neutral position as well as when the meter-in spool 19 is located at a second position that is on the other side of the neutral position, a first load checking valve 2 disposed between said outlet port 12 and a first actuator port 72 and adapted to be held in a closed state in response to an external signal;

a second load checking valve 3 disposed between said outlet port 12 and a second actuator port 74 and adapted to be held in a closed state in response to an external signal; and a meter-out flow control valve 4 for establishing fluid communication of one of said first actuator port 72 and said second actuator port 74 with a tank port 71, in which:

each of said first and second load checking valves 2 and 3 is adapted to be held in a closed state in the presence of pressure fluid acting on a pressure receiving area thereof and is adapted to operate in an open state with pressure fluid in the outlet port 12 in the absence of pressure fluid so acting on the pressure receiving area, so that locating said meter-in spool 19 at its first position establishes fluid communication of the first pump port with the pressure receiving area 46 of the first load checking valve 2 to feed pressure fluid and locating said meter-in spool 19 at its second position establishes fluid communication of the second pump port with the pressure receiving area 46 of the second load checking valve 3 to feed pressure fluid.

6. A directional control valve system comprising:

a meter-in flow control valve 1 constructed: to include an outlet port 12, a first pump port 13, a second pump port 16 and a meter-in spool 19 and to be operable to block fluid communication between the ports when the meter-in spool 19 is located at a neutral position thereof and to be operable to establish fluid communication between the ports when the meter-in spool 19 is located at a first position that is on one side of the neutral position as well as when the meter-in spool 19 is located at a second position that is on the other side of the neutral position, a first load checking valve 2 disposed between said outlet port 12 and a first actuator port 72 and adapted to be held in a closed state in response to an external signal;

a second load checking valve 3 disposed between said outlet port 12 and a second actuator port 74 and adapted to be held in a closed state in response to an external signal; and a meter-out flow control valve 4 for establishing fluid communication of one of said first actuator port 72 and said second actuator port 74 with a tank port 71, in which:

each of said first and second load checking valves 2 and 3 is adapted to be held in a closed state in the presence of pressure fluid acting on a pressure receiving area thereof and is adapted to operate in an open state with pressure fluid in the outlet port 12 in the absence of pressure fluid so acting on the pressure receiving area, there being formed:

a fluid feed passage for establishing fluid communication of the first pump port 13 with the pressure receiving area of the first load checking valve 2 and fluid communication of the second pump port 16 with the pressure receiving area of the second load checking valve 3 when said meter-in spool 19 lies at its neutral position, a fluid feed passage for establishing fluid communication of the first pump port 13 with the pressure receiving area of the first load checking valve 2 and fluid communication of the pressure receiving area of the second load checking valve 3 with the tank port when the meter-in spool 19 lies at its first position, and a fluid feed passage for establishing fluid communication of the second pump port 16 with the pressure receiving area of the second load checking valve 3 and fluid communication of the pressure receiving area of the first load checking valve 2 with the tank port when the meter-in spool 19 lies at its second position.

7. A directional control valve system as set forth in claim 6 in which when or before the first and second pump ports 13 and 16 communicate with the outlet port 12, the pressure receiving areas of the second and first load checking valves 3 and 2 are allowed to communicate with the tank port.

8. A directional control valve system, comprising:

a meter-in flow control valve 1 for establishing fluid communication of a pump port with a single outlet port 12;

a first load checking valve 2 disposed between said outlet port 12 and a first actuator port 72 and adapted to be held in a closed state by a pump discharge pressure;

a second load checking valve 3 disposed between said outlet port 12 and a second actuator port 74 and adapted to be held in a closed state by a pump discharge pressure; and a meter-out flow control valve 4 for establishing fluid communication of one of said first actuator port 72 and said second actuator port 74 with a tank port 71, in which;

one of said first and second load checking valves 2 and 3 and said meter-out flow control valve 4 are adapted to be switched over depending on the position of a meter-in spool of the meter-in flow control valve 1 and thereby each to be held in a closed state as well as to be operatively switched.

9. A directional control valve system, comprising:

a meter-in flow valve 1 constructed:

to include an outlet port 12, a first pump port 13, a second pump port 16 and a meter-in spool 19 and to be operable to block fluid communication between the ports when the meter-in spool 19 is located at a neutral position thereof and to be operable to establish fluid communication between the ports when the meter-in spool 19 is located at a first position that is on one side of the neutral position as well as when the meter-in spool 19 is located at a second position that is on the other side of the neutral position, a first load checking valve 2 disposed between said outlet port 12 and a first actuator port 72 and adapted to be held in a closed state by a pump discharge pressure;

a second load checking valve 3 disposed between said outlet port 12 and a second actuator port 74 and adapted to be held in a closed state by a pump discharge pressure; and a meter-out flow control valve 4 for establishing fluid communication of one said first actuator port 72 and said second actuator port 74 with a tank port 71, in which:

one of said first and second load checking valves 2 and 3 and said meter-out flow control valve 4 are adapted to be switched over depending on the position of the meter-in spool of the meter-in flow control valve 1 and thereby each to be held in a closed state as well as to be operatively switched.

10. A directional control valve system as set forth on claim 5, claim 6, claim 7, claim 8 or claim 9, comprising:

a first meter-in electromagnetic proportional control valve 23 causing the meter-in spool 19 for said meter-in flow control valve 1 to assume its first position, a second meter-in electromagnetic valve 29 causing the meter-in spool 19 to assume its second position, a meter-out electromagnetic proportional pressure control valve 81, and a pilot switching valve 87 for switching an output pressure of said electromagnetic proportional pressure control valve 81 over to a first and a second switchover pressure for switching the meter-out flow control valve 4, in which said pilot switching valve 87 is adapted to be operatively switched with a fluid for holding the first load checking valve 2 in a closed state.

11. A directional control valve system, comprising:

a meter-in flow control valve 1 for establishing and blocking fluid communication of a pump port with a single outlet port 12;

a first load checking valve 2 disposed between said outlet port 12 and a first actuator port 72 and adapted to be held in a closed state in response to an external signal;

a second load checking valve 3 disposed between said outlet port 12 and a second actuator port 74 and adapted to be held in a closed state in response to an external signal; and a meter-out flow control valve 4 for establishing fluid communication of one of said first actuator port 72 and said second actuator port 74 with a tank port 71, in which:

said meter-in flow control valve 1 is constructed to include an outlet port 12, a first pump port 13, a second pump port 16 and a meter-in spool 19 and to be operable to block fluid communication between the ports when the meter-in spool 19 is located at a neutral position thereof and to be operable to establish fluid communication between the ports when the meter-in spool 19 is located at a first position that is on one side of the neutral position as well as when the meter-in spool 19 is located at a second position that is on the other side of the neutral position, each of said first and second load checking valves 2 and 3 is adapted to be held in a closed state in the presence of pressure fluid acting on a pressure receiving area thereof and is adapted to operate in an open state with pressure fluid in the outlet port 12 in the absence of pressure fluid so acting on the pressure receiving area, so that locating said meter-in spool 19 at its first position establishes fluid communication of the first pump port with the pressure receiving area 46 of the first load checking valve 2 to feed pressure fluid and locating said meter-in spool 19 at its second position establishes fluid communication of the second pump port with the pressure receiving area 46 of the first load checking valve 3 to feed pressure fluid, further comprising:

a first meter-in electromagnetic proportional control valve 23 for causing the meter-in spool 19 to assume its first position, a second meter-in electromagnetic proportional control valve 29 for causing the meter-in spool 19 to assume its second position, a meter-out electromagnetic proportional pressure control valve 81, a first pilot switching valve 87-1 for controllably applying an output pressure of said electromagnetic proportional pressure control valve 81 into a first pressure receiving chamber 79 to establish a first state of the meter-out flow control valve 4 in which a first actuator port 72 communicates with a drain port 71, and a second pilot switching valve 87-2 for controllably applying an output pressure of said electromagnetic proportional pressure control valve 81 into a second pressure receiving chamber 80 to establish a second state of the meter-out flow control valve 4 In which a second actuator port 74 communicates with a drain port 71, so that pressure fluid in the pressure receiving area of said first load checking valve 2 causes the first pilot switching valve 87-1 to assume a position of fluid communication, and pressure fluid in the pressure receiving area of said second load checking valve 3 causes the second pilot switching valve 87-2 to assume a position of communication.

12. A directional control valve system, comprising:

a meter-in flow control valve 1 for establishing and blocking fluid communication of a pump port with a single outlet port 12;

a first load checking valve 2 disposed between said outlet port 12 and a first actuator port 72 and adapted to be held in a closed state by a pump discharge pressure;

a second load checking valve 3 disposed between said outlet port 12 and a second actuator port 74 and adapted to be held in a closed state by a pump discharge pressure; and a meter-out flow control valve 4 for establishing fluid communication of one said first actuator port 72 and said second actuator port 74 with a tank port 71, in which:

said meter-in flow control valve 1 is constructed to include an outlet port 12, a first pump port 13, a second pump port 16 and a meter-in port 19 and to be operable to block fluid communication between the port when the meter-in spool 19 is located at a neutral positional thereof and to be operable to establish fluid communication between the ports when the meter-in spool 19 is located at a first position that is on one side of the neutral position as well as when the meter-in spool 19 is located at a second position that is on the other side of the neutral position, and said meter-in and meter-out flow control valves 1 and 4 are operable to effect a switching operation in response to an output pressure of one of a single hydraulic pilot valve 120 and a single electromagnetic proportional control valve.

* * * * *